US009155149B2

(12) United States Patent
Pan

(10) Patent No.: US 9,155,149 B2
(45) Date of Patent: Oct. 6, 2015

(54) SELF-ADAPTIVE DRIVE CIRCUIT AND LED LAMP WITH THE SAME

(71) Applicant: GUANGZHOU IETHAI LIGHTING ELECTRONIC TECHNOLOGY CO., LTD., Guangzhou, Guangdong (CN)

(72) Inventor: Weixiong Pan, Guangdong (CN)

(73) Assignee: Guangzhou Iethai Lighting Electronic Technology Co., Ltd., Guangdong (CN)

( * ) Notice: Subject to any disclaimer, the term of this patent is extended or adjusted under 35 U.S.C. 154(b) by 8 days.

(21) Appl. No.: 13/928,361

(22) Filed: Jun. 26, 2013

(65) Prior Publication Data

US 2014/0306614 A1 Oct. 16, 2014

(30) Foreign Application Priority Data

Apr. 12, 2013 (CN) ..... 2013 1 0125901

(51) Int. Cl.
*H05B 33/08* (2006.01)

(52) U.S. Cl.
CPC ..... *H05B 33/0824* (2013.01)

(58) Field of Classification Search
CPC ..... H05B 41/24; H05B 33/0809; H05B 33/0821; H05B 33/0896; H05B 33/0818; H05B 33/083
USPC ..... 315/250, 294, 193, 185 R, 200 R, 291
See application file for complete search history.

(56) References Cited

U.S. PATENT DOCUMENTS

| | | | | |
|---|---|---|---|---|
| 8,164,276 | B2 * | 4/2012 | Kuwabara | 315/294 |
| 2007/0159421 | A1 | 7/2007 | Peker | |
| 2008/0094000 | A1 * | 4/2008 | Yamamoto et al. | 315/250 |
| 2010/0164403 | A1 * | 7/2010 | Liu | 315/297 |
| 2010/0308739 | A1 * | 12/2010 | Shteynberg et al. | 315/193 |
| 2011/0089844 | A1 * | 4/2011 | Grajcar | 315/193 |
| 2011/0273102 | A1 * | 11/2011 | van de Ven et al. | 315/193 |
| 2012/0212144 | A1 * | 8/2012 | Hayashi et al. | 315/193 |
| 2012/0313543 | A1 * | 12/2012 | Zhao et al. | 315/224 |
| 2013/0169160 | A1 * | 7/2013 | Kim et al. | 315/122 |
| 2013/0169175 | A1 * | 7/2013 | Grajcar | 315/193 |
| 2014/0139112 | A1 * | 5/2014 | Shteynberg et al. | 315/122 |

FOREIGN PATENT DOCUMENTS

| | | |
|---|---|---|
| CN | 201590932 | 9/2010 |
| CN | 101711066 | 8/2012 |
| CN | 202503745 | 10/2012 |

* cited by examiner

*Primary Examiner* — Jimmy Vu
*Assistant Examiner* — Wei Chan
(74) *Attorney, Agent, or Firm* — Kolisch Hartwell, P.C.

(57) ABSTRACT

The invention relates to a technical field of light emitting diodes (LEDs), in particular to a self-adaptive drive circuit and an LED lamp with the same. The LED lamp comprises a plurality of series LED lamp strings, and each LED lamp string comprises at least one series LED lamp bead; and the self-adaptive drive circuit comprises a rectifying unit, a current limiting unit, a voltage detection and connectivity control unit and at least one controllable switch unit. According to the self-adaptive drive circuit and the LED lamp with the same, the LEDs can be driven normally in an extremely simple drive mode, which can work without using complex constant current drive circuit and electrolytic capacitor that is life limiting. At the same time, the stroboflash phenomenon is eliminated, the power factor is improved, harmonic distortion is reduced, electromagnetic interference is eliminated, and the cost is reduced.

15 Claims, 5 Drawing Sheets

SELF-ADAPTIVE DRIVE CIRCUIT AND LED LAMP WITH THE SAME

BACKGROUND OF THE INVENTION

1. Field of the Invention

The invention relates to a technical field of light emitting diodes (LEDs), in particular to a self-adaptive drive circuit and an LED lamp with the same.

2. Description of the Prior Art

LED, having high luminous efficiency, long service life, solid light source, without polluting heavy metal elements, and other remarkable advantages, is now becoming a new generation of light source and leading a third illumination revolution after the incandescent lamps and the fluorescent lamps.

LED (light emitting diode) has electrical features similar to those of a diode, which is a constant voltage device and is very sensitive to an applied working voltage, and the I/V thereof is in a relation of exponential rise. Generally, the LED can work normally by incorporating a drive power supply that can provide a current-limiting function or a constant current function, and the input mains supply is converted to the constant DC (direct current) generally by adopting a special LED power supply to drive the LED to work stably.

The LED drive power supply generally adopts an AC to DC circuit such as a flyback, or a logical link control (LLC), which may contain an input filter, a rectifier, a constant current and control circuit, a metal oxide semiconductor (MOS) transistor, a transformer, an output rectifier filter and the like. Accordingly, the elements are numerous, the circuit is complex, the design is difficult, and the cost is therefore high. For example, the cost of high quality LED drive power supply is about 1.5-3 yuan/W. Since the circuit usually contains various elements, especially those with life limitation, such as electrolytic capacitor, the life of the drive power supply is limited, thereby limiting the life of the whole LED lamp as well. In most cases, the power supply malfunctions before the LED lamp beads reach the service lives, so the advantage of long life of the LED cannot be fully exerted. Moreover, since the circuit works in a high-frequency switch state, and electromagnetic interference is inevitably generated, which is easy to affect the power grid and bring to bad effects to surrounding radio equipment. Accordingly, the electro magnetic compatibility (EMC) design of the drive power supply is still a big problem that puzzles the designing engineers.

Recently, an alternating-current LED lamp without using a drive power supply appears in the market, wherein the alternating-current LED lamp beads (or reversed common lamp beads) are directly connected to the mains supply by the resistors that limit the currents. It is advantageous that the drive power supply is not used, the cost is low and the life is not limited by the power supply. However, since many LED lamp beads are connected in series and connected to the mains supply, the total voltage of the LED lamp beads approaches the effective value of the mains supply, leading to a fatal defect including the serious stroboflash phenomenon, and since the power factor is low, the harmonic may cause large disturbance to the power grid.

A patent "LED Working Mode Control Device (Chinese patent publication number 202503745U") also provides an LED driving mode which connects the LEDs to the power supply section by section to adapt to power supply voltage fluctuation (for example, after the mains supply is rectified). By utilizing a switchable short-circuit LED module, when the power supply voltage is low, fewer LEDs are connected; when the power supply voltage is high, more LEDs are connected, thereby making the LEDs being able to adapt to the power supply voltage fluctuation. However, the controllable switches in the disclosure are all connected in series to the LED circuits. Since the controllable switch may itself contain the saturation voltage drop or the turn-on resistance, it is bound to consume more powers. When the lower the input voltage is, the more the series controllable switches are, leading to higher resistance of the controllable switches and more consumed power. The efficiency of the circuit is therefore greatly reduced. Meanwhile, the voltage detection and switch control part provided by the patent is independent, so many elements are adopted, and the circuit is complex.

SUMMARY OF THE INVENTION

To resolve the problem of stroboflash when eliminating the constant drive circuit and the electrolytic capacitor in conventional arts, the invention provides a self-adaptive drive circuit and an efficient LED lamp with the same.

The LED lamp with the self-adaptive drive circuit comprises a plurality of LED lamp strings, and each LED lamp string comprises a plurality of series LED lamp beads; the self-adaptive drive circuit comprises a rectifying unit, a current limiting unit, a voltage detection and connectivity control unit and a plurality of controllable switch units.

The rectifying unit is used for converting an alternating-current voltage input by an alternating-current power supply into a rectified drive voltage.

The voltage detection and connectivity control unit is used for controlling connection/disconnection of the controllable switch units according to comparison results of the drive voltage and a plurality of reference voltages, wherein each reference voltage is associated with one controllable switch unit, and the voltage detection and connectivity control unit turns off and disconnects the controllable switch unit where the reference voltage thereof is higher than the drive voltage, and turns on and connects the controllable switch unit where the reference voltage thereof is lower than the drive voltage;

The controllable switch units are used for controlling connection/disconnection from the series LED lamp strings to the negative power end of the rectifying unit.

The current limiting unit is used for performing current limitation or constant current on the drive voltage and then inputting the drive voltage to the first of the LED lamp strings.

Further, the voltage detection and connectivity control unit comprises a plurality of reference voltage divider resistors and a stable voltage source, and the reference voltage divider resistors are used for dividing the voltage output of the stable voltage source into a plurality of reference voltages.

Further, the input end of the rectifying unit is connected to the alternating-current (AC) voltage, and the output end of the rectifying unit is connected with the input end of the voltage detection and connectivity control unit. The connecting point of each LED lamp string is grounded through the controllable switch unit. The output end of the rectifying unit is connected with the first of the LED lamp strings through the current limiting unit, and the output end of the voltage detection and connectivity control unit is connected with the control ends of the controllable switch units.

Further, the voltage detection and connectivity control unit comprises a plurality of comparators connected with the controllable switch units, wherein the comparators are used for controlling connection/disconnection of the controllable switch units connected with the comparators according to the comparison results of the drive voltage and the reference voltages.

Further, the voltage detection and connectivity control unit comprises a singlechip, and an analog-digital converter of the singlechip is connected with the output end of the rectifying unit and is used for detecting the comparison results of the drive voltage and the reference voltages in real time and controlling connection/disconnection of the controllable switch units connected with the output port of the singlechip.

An self-adaptive drive circuit of the LED lamp is used for supplying power to the LED lamp, the LED lamp comprises a plurality of series LED lamp strings, wherein each LED lamp string comprises at least one series LED lamp bead, and the self-adaptive drive circuit comprises a rectifying unit, a current limiting unit, a voltage detection and connectivity control unit and a plurality of controllable switch units.

The rectifying unit is used for converting an alternating-current voltage input by an alternating-current power supply into a rectified drive voltage.

The voltage detection and connectivity control unit is used for controlling connection/disconnection of the controllable switch units according to the change of the drive voltage, wherein each reference voltage is associated with a controllable switch unit. and the voltage detection and connectivity control unit turns off and disconnects the controllable switch unit where the reference voltage thereof is higher than the drive voltage, and the voltage detection and connectivity control unit turns on and connects the controllable switch unit where the reference voltage thereof is lower than the drive voltage;

The controllable switch units are used for controlling the connection/disconnection from the series LED lamp strings to the negative power end of the rectifying unit.

The current limiting unit is used for performing current limitation or constant current on the drive voltage and then inputting the drive voltage to the first of a plurality of series LED lamp strings.

The positive power end of the rectifying unit is connected with the voltage detection and connectivity control unit and the input end of the current limiting unit respectively. The output end of the voltage detection and connectivity control unit is connected with the control ends of the controllable switch units. The output end of the current limiting unit is connected with the first of the plurality of series LED lamp strings. The series LED lamp strings are connected with the negative power end of the rectifying unit through the controllable switch units respectively.

Further, the voltage detection and connectivity control unit comprises a plurality of reference voltage divider resistors and a stable voltage source, wherein the reference voltage divider resistors are used for dividing the voltage output of the stable voltage source into a plurality of reference voltages.

Further, the input end of the rectifying unit is connected to the alternating-current voltage, the output end of the rectifying unit is connected with the input end of the voltage detection and connectivity control unit, each controllable switch unit is grounded one end of and is connected with the connecting point of every two adjacent LED lamp strings at the other end, the output end of the rectifying unit is connected with the first of the plurality of series LED lamp strings through the current limiting unit, and the output end of the voltage detection and connectivity control unit is connected with the control ends of the controllable switch units.

Further, the voltage detection and connectivity control unit comprises a plurality of comparators connected with the controllable switch units, wherein the comparators are used for controlling the connection/disconnection of the controllable switch units connected with the comparators according to the comparison results of the drive voltage and the reference voltages.

Further, the voltage detection and connectivity control unit comprises a singlechip, and an analog-digital converter of the singlechip is connected with the positive power end of the rectifying unit and is used for detecting the comparison results of the drive voltage and the reference voltages in real time and controlling the connection/disconnection of the controllable switch units connected with the output port of the singlechip.

According to the self-adaptive drive circuit and the LED lamp with the same, the series LED lamp beads can automatically adapt to the change of the drive voltage by controlling the quantity or the number of the connected LEDs. The higher the drive voltage is, the more numbers of the connected LEDs are. The lower the drive voltage is, the fewer the connected LEDs are. The total voltage drop of the LEDs can follow the change of the drive voltage. By using the simple control circuit and the current limiting or constant current circuit, the LEDs can be connected to the mains supply and the LEDs can be driven normally in an extremely simple drive mode, which can work without using complex constant current drive circuit and electrolytic capacitor that is life limiting. At the same time, the stroboflash phenomenon is eliminated, the power factor is improved, harmonic distortion is reduced, electromagnetic interference is eliminated, and the cost is reduced.

These and other objectives of the present invention will no doubt become obvious to those of ordinary skill in the art after reading the following detailed description of the preferred embodiment that is illustrated in the various figures and drawings.

DETAILED DESCRIPTION

The invention is further described in detail in conjunction with the drawings and the embodiments.

Figure 1:
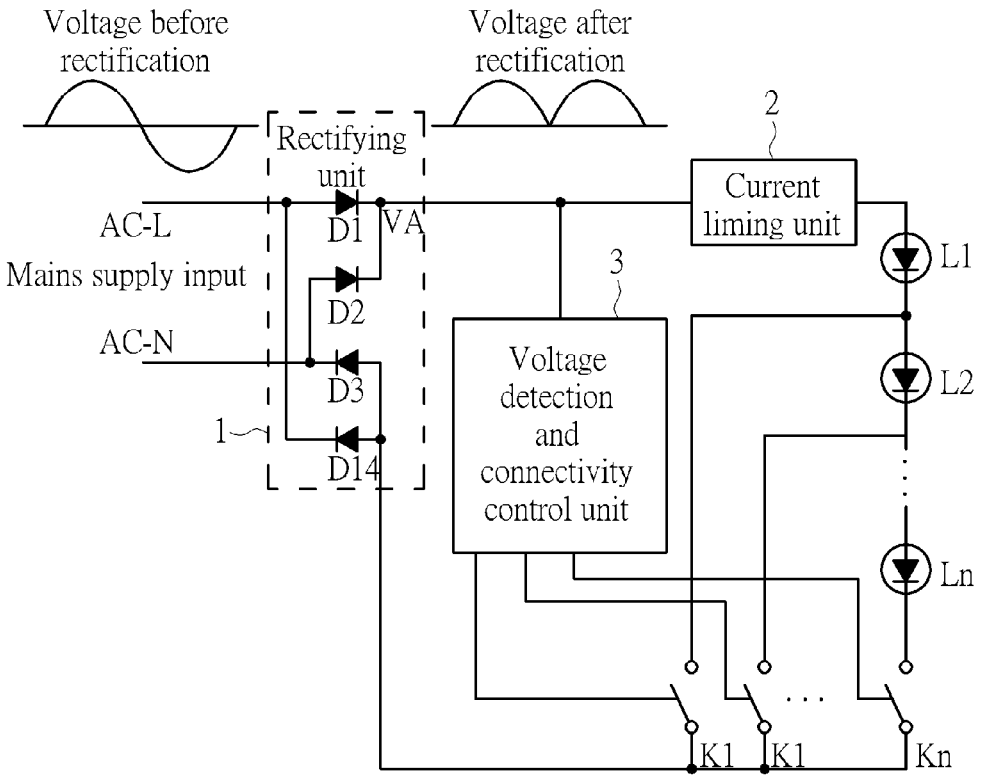
FIG. 1 is a structural schematic diagram of an LED lamp with a self-adaptive drive circuit of the invention.

FIG. 1 shows an LED lamp with a self-adaptive drive circuit. The LED lamp comprises a plurality of series LED lamp strings L1, L2, . . . , Ln, and each LED lamp string comprises a plurality of series LED lamp beads (not shown in the diagram); the self-adaptive drive circuit comprises a rectifying unit 1, a current limiting unit 2, a voltage detection and connectivity control unit 3 and a plurality of controllable switch units K1, K2, . . . , Kn.

The rectifying unit 1, namely a rectifying circuit consisting of D1-D4 in the diagram, is used for converting an alternating-current voltage output by an alternating-current power supply into a rectified drive voltage.

The voltage detection and connectivity control unit 3 is used for controlling connection/disconnection of the controllable switch units according to the change of the drive voltage, wherein each reference voltage is associated with one controllable switch unit. The voltage detection and connectivity control unit is also used for turning off and disconnecting the controllable switch units when the reference voltages is higher than the drive voltage and turning on and connecting at least one controllable switch unit when the reference voltage is lower than the drive voltage.

The controllable switch units are used for controlling the connection/disconnection from the series LED lamp strings to the negative power end of the rectifying unit, wherein K1 controls the LED lamp string L1, K2 controls the LED lamp string L2, . . . , and Kn controls the LED lamp string Ln.

The current limiting unit 2 is used for performing current limitation or constant current on the drive voltage and then inputting the drive voltage to the first of the plurality of series LED lamp strings, wherein the current limitation can be implemented by using resistors connected in series to the circuit, and the constant current can be implemented by adopting a constant current source circuit.

In one embodiment, the input end of the rectifying unit 1 is connected to the alternating-current voltage. The output end of the rectifying unit 1 is connected with the input end of the voltage detection and connectivity control unit 3. The connecting point of each LED lamp string is grounded through the controllable switch unit. The output end of the rectifying unit 1 is connected with the first of the plurality of series LED lamp strings through the current limiting unit 2. The output end of the voltage detection and connectivity control unit 3 is connected with the control ends of the controllable switch units K1, K2, . . . , Kn.

The working principle is shown as follows: the mains supply is rectified through the rectifying unit 1 and then changed into fluctuating direct current. That is, the alternating-current voltage output by the alternating-current power supply is converted into the rectified drive voltage. The voltage detection and connectivity control unit 3 detects the change of the drive voltage in real time, and drives a part of controllable switch units to be connected when the drive voltage is low and drives the other part of controllable switch units to be connected when the drive voltage is high. The LED lamp strings are connected in series section by section, and each section is respectively connected with the controllable switch units communicated with different voltage sections. The series quantity of the LED lamp strings follows the change of the drive voltage, meaning that fewer LED lamp strings are connected in series when the drive voltage is low, and more LED lamp strings are connected in series when the drive voltage is high, so that a part of LED lamp strings are connected when the voltage is low, and more LED lamp strings are connected when the voltage is high. By doing this, the total voltage drop of the LEDs always approaches the drive voltage, and the LEDs can be protected from the over-current damage when the drive voltage is too high. Meanwhile, since the LED lamp strings are connected in the whole change period of the mains supply voltage, the stroboflash phenomenon is eliminated, and high power factor and low harmonic distortion are kept. In this way, the power factor can easily reach more than 0.95, and the harmonic can be less than 20 percent.

Theoretically, it is preferably that the LED lamp strings are divided into more sections in the drive mode, so the LED lamp strings can tightly follow the change of the drive voltage, and the voltage drop of the current limiting unit is becoming low, the consumed power is becoming low as well, thereby improving the whole efficiency. However, due to the more number of the voltage detection and the drive unit, the cost is increased as well. After weighing, it is preferably that the low-power LEDs are divided into 4 to 6 sections, and the high-power LEDs are divided into 4 to 10 sections, so both the cost and the performance can be compatible. Without forming a short-circuit or an open-circuit, the corresponding LED strings in the present invention are directly grounded and connected with each other according to the magnitude of the drive voltage by the controllable switch units of the patent, and no matter the drive voltage is high or low, only one or no connected controllable switch is connected in series with the LED circuit at any time, meaning that only one or no controllable switch unit consumes the power at any time. Accordingly, the efficiency of the circuit in the present invention is upgraded.

Figure 2:
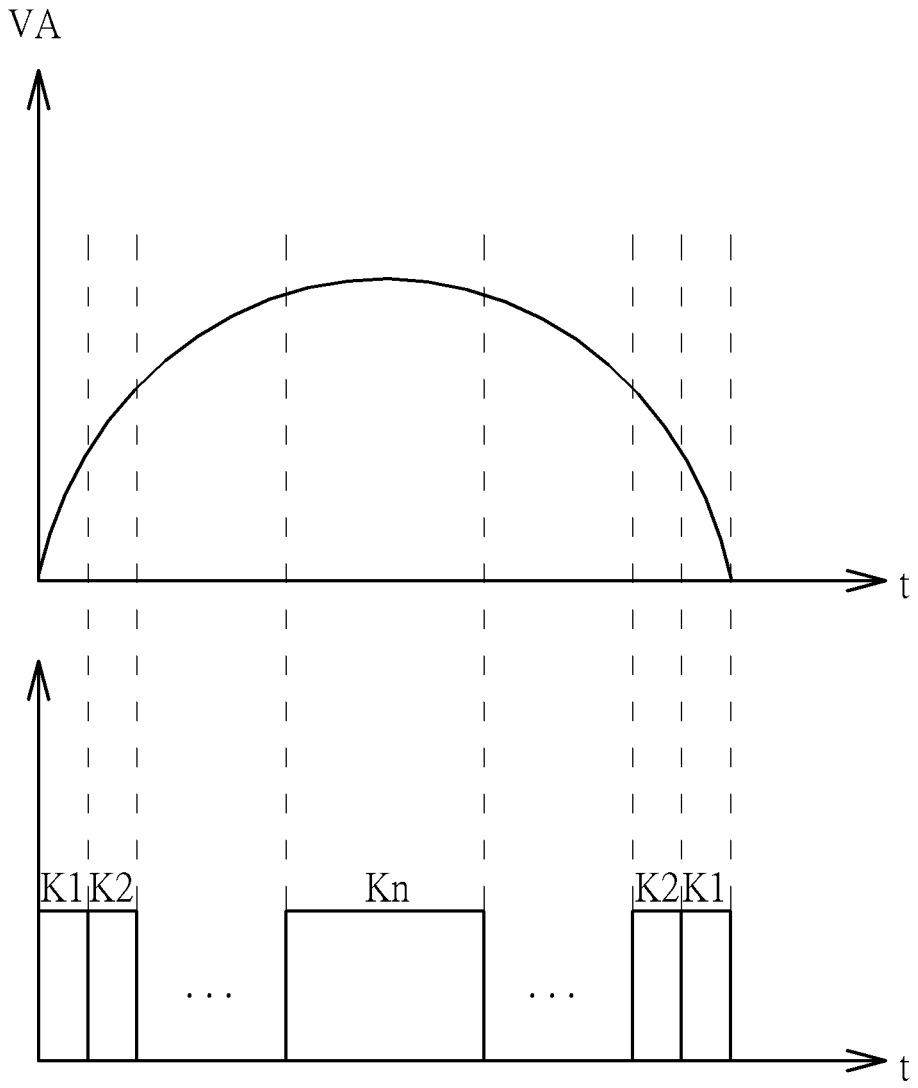
FIG. 2 is a schematic diagram of connection/disconnection of controllable switch units and change of a drive voltage of the invention.

As shown in FIG. 1, the LED lamp is provided with L1, L2, . . . , Ln LED lamp strings and corresponding K1, K2, . . . , Kn controllable switch units, and each LED lamp string is formed by serially connecting a plurality of LED lamp beads which are adjusted according to the magnitude of the mains supply and the string quantity. The alternating-current mains supply is rectified by the rectifying unit 1 and changed into a fluctuating direct current for driving the LED lamp strings. The rectified voltage becomes the drive voltage. The voltage detection and connectivity control unit 3 detects the magnitude of the drive voltage in real time. The control circuit controls K1 to be connected when the voltage is low, meaning that the LED lamp string L1 (formed by serially connecting a plurality of LED lamp beads, the same below) is connected and lightened; when the voltage rises, the voltage detection and connectivity control unit 3 controls the K1 to be disconnected and the K2 to be connected, meaning that the L1 and the L2 are connected in series and lightened. After connecting the L1 and the L2 in series, the total voltage drop rises, making the circuit being able to adapt to the change of drive voltage rise. The LEDs are therefore prevented from being damaged by over-current due to too high drive voltage and can normally work and lighten. Similarly, when the drive voltage is about to reach the maximum, Kn is connected, and the others are disconnected, meaning that all the LED lamp strings are connected in series, and the voltage drop also reaches the maximum. When the drive voltage starts to decline, the process is repeated, the connection/disconnection sequence of K1 to Kn is reverse: Kn is first connected, and K1 is finally connected. The final result shows that the voltage drop of the LED lamp strings can follow the change of the drive voltage. By incorporating the current limiting unit 2, the LEDs can work normally in a range of the drive voltage and the drive current. FIG. 2 shows the schematic diagram of the connection and the disconnection of the controllable switch units and the change of the drive voltage.

The voltage of the mains supply is set as U, the quantity of the total LED lamp strings is n, the voltage drop of each LED lamp string is U1, and the design satisfies the following relation:

$$n*U1<1.4*U$$

That is, the total voltage drop of all the connected LED strings is less than the peak of the mains supply.

After reading the patent, one of ordinary skilled in the art can set a specific reference voltage, for example, by using a plurality of different stable voltage sources as the reference voltages. In one embodiment, the voltage detection and connectivity control unit also comprises a plurality of reference voltage divider resistors and a stable voltage source, wherein the reference voltage divider resistors are used for dividing the voltage output of the stable voltage source into a plurality of reference voltages. A plurality of different reference voltages can be acquired through the reference voltage divider resistors, so as to control the controllable switch units. In the embodiment, only one stable voltage source is required, and a plurality of different reference voltages are required, so the structure is simple. As the same reference voltage is divided, a plurality of reference voltages are different proportions of the same stable voltage source and the LED lamp strings are coarsened in the same proportion, the quantity of the connected LED lamp strings can be reflected accurately, and the efficiency of the circuit is high.

The voltage detection and connectivity control unit 3 can be implemented by using a singlechip or an analog circuit such as a comparator, and the controllable switch units can be bipolar transistors or MOS transistors.

In one embodiment, the voltage detection and connectivity control unit 3 comprises a plurality of comparators connected with the controllable switch units, wherein the comparators are used for controlling the connection/disconnection of the controllable switch units K1, K2, . . . , Kn according to the comparison results of the drive voltage and the reference voltages.

In one embodiment, the output end of each comparator is connected with the control end of one of the controllable switch units K1, K2, . . . , Kn. The first input end of each comparator is used for detecting the change of the drive voltage. The voltage detection and connectivity control unit also comprises a plurality of reference voltage divider resistors and a stable voltage source, wherein the reference voltage divider resistors are used for dividing the voltage output of the stable voltage source into a plurality of reference voltages and inputting the reference voltages to the second input ends of the comparators respectively.

In one embodiment, the voltage detection and connectivity control unit also comprises at least two drive voltage divider resistors, wherein the drive voltage divider resistors are used for dividing the drive voltage and inputting the drive voltage to the first input ends of the comparators.

In another embodiment, the voltage detection and connectivity control unit 3 consists of a singlechip, and the output end (I/O) of the singlechip is connected with the control ends of the controllable switch units K1, K2, . . . , Kn, and an analog-digital converter (ADC) of the singlechip is connected with the positive power end of the rectifying unit 1 and is used for detecting the change of the drive voltage in real time. The singlechip is used for detecting the magnitude of the LED drive voltage in real time and controlling the connection/disconnection of the controllable switch units K1, K2, . . . , Kn according to the magnitude of the drive voltage.

The self-adaptive drive circuit of the LED lamp of the invention is used for supplying power to the LED lamp, and the principle of the self-adaptive drive circuit similar with the above and is not repeated herein.

Figure 3:
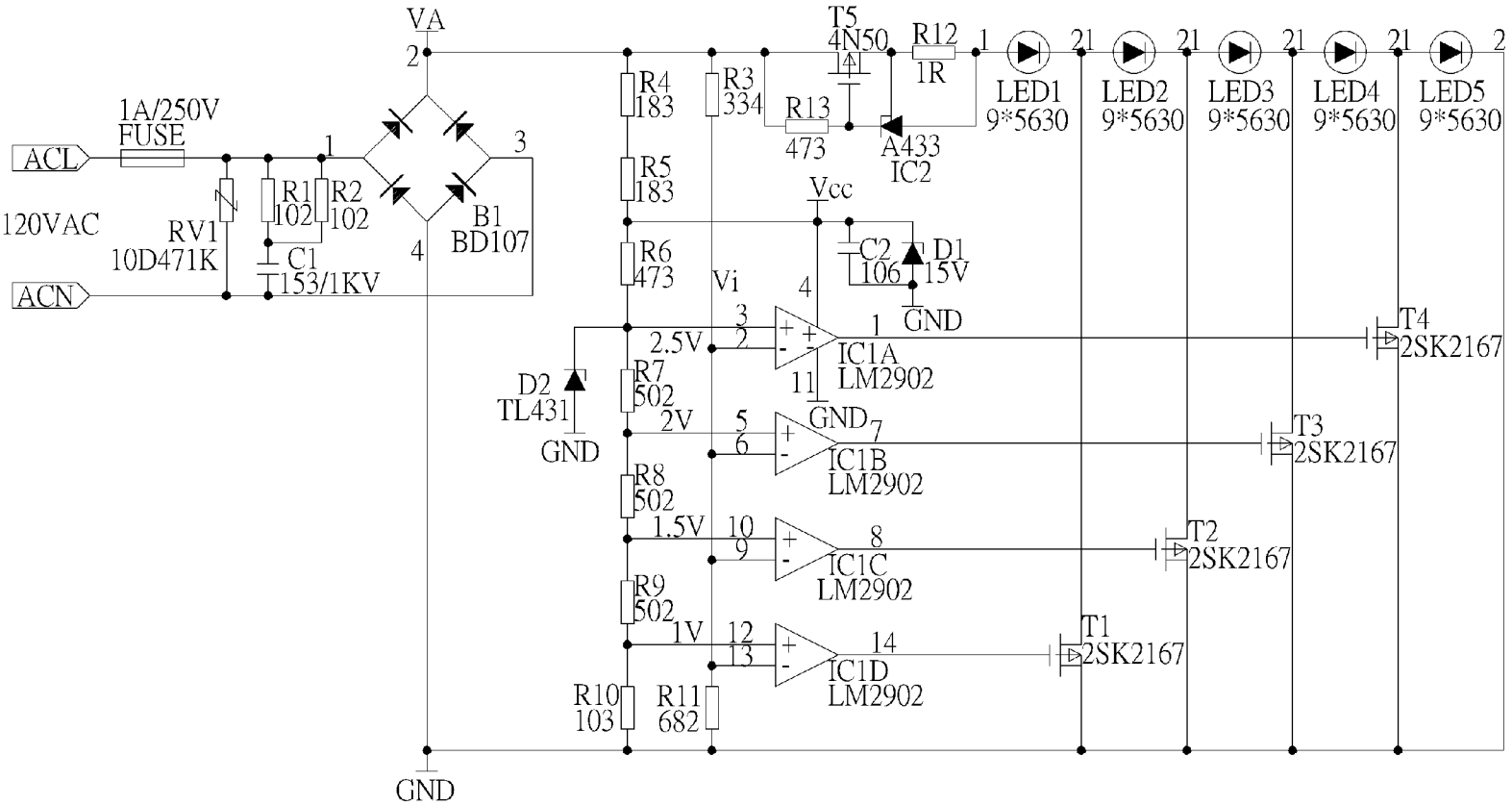
FIG. 3 is a circuit diagram of the LED lamp with the self-adaptive drive circuit of the invention.

FIG. 3 shows an example of the invention.

A 24 W LED dimmable ceiling lamp with 120 VAC input is designed in the example.

The mains supply is 120V alternating current for example. After the mains supply passes through a FUSE, it is changed from an alternating current to a fluctuating direct current VA by a bridge rectifier B1 to serve as the drive voltage of the LED lamp. RV1 is a lightning protection piezo-resistor, and R1, R2 and C1 are used for supplying continuous current to a controllable silicon dimmer.

The LED lamp is formed by serially connecting five LED lamp strings: LED1, LED2, LED3, LED4 and LED5, wherein each lamp string is formed by serially connecting nine Samsung 5630 lamp beads, so an LED lamp string in the diagram represents nine series LED lamp beads. The voltage of a single 5630 is about 3.2V, and the voltage of the series nine lamp beads is:

$$9*3.2=28.8V$$

The total voltage of the five strings of LED lamp beads is:

$$5*28.8=144V,$$

which is lower than the peak of the mains supply: 120*1.4=168V.

By weighting the cost/performance, single-power-supply quad operational amplifiers LM2902 (IC1A, IC1B, IC1C and IC1D in FIG. 3) are used as voltage comparators for detecting the change of the LED drive voltage VA. R4, R5, C2 and D1 supply 15V power to the operational amplifiers. A precision voltage stabilizer TL431 (D2 in FIG. 3) and the divider resistors (R7, R8, R9 and R10) respectively supply the reference voltages of 2.5V, 2V, 1.5V and 1V to the "−" input ends of the four comparators. VA is divided by resistors R3 and R11 and then connected to the "+" input ends (Vi) of the operational amplifiers. The voltage division ratio is designed, so that the output relation of VA, Vi and the comparators is as follows:

$$Vi=VA*R11/(R3+R11)$$

TABLE 1

| VA | Vi | Comparator A | Comparator B | Comparator C | Comparator D |
|---|---|---|---|---|---|
| <49.5 V | <1 V | high output | high output | high output | high output |
| >49.5 V | >1 V | high output | high output | high output | low output |
| >74.3 V | >1.5 V | high output | high output | low output | low output |
| >99 V | >2 V | high output | low output | low output | low output |
| >124 V | >2.5 V | low output | low output | low output | low output |

The current limiting circuit is consisted of an IC2 reference voltage source and a constant current circuit including an MOS transistor T5, an R12 and an R13. The controllable switch unit is realized by MOS transistors (T1, T2, T3 and T4 in FIG. 3). The output ends of the comparators are connected with the grids of the MOS transistors, so the MOS transistors are turned on when the outputs of the comparators are high; the MOS transistors are turn off when the outputs of the comparators are low. The output states of the comparators directly control the connection and the disconnection of the MOS transistors. Referring to table 1 correspondingly, when the drive voltage is less than 49.5V, T1 is turned on due to high output of the comparator D, meaning that LED 1 is connected with the power supply VA through the constant current circuit and is lightened. LED 1 can normally lighten and work in an allowable range due to low drive voltage and the limitation effect of the constant current circuit. When the drive voltage is more than 49.5V and less than 74.3V, T1 is turned off due to low output of the comparator D and T2 is turned on due to high output of the comparator C, meaning that LED1 and LED2 are connected in series and father connected with the power supply VA through the constant current circuit. As VA rises, the voltage of LED1 and LED2 connected in series also rises, in conjunction with the current limiting effect of the constant current circuit the LED can still work in the normal range. Further, when VA is more than 124V, T1-T4 are all turned off, and LED1-LED4 are all connected in series and then connected to VA. The LED voltage reaches the maximum, and the LED can still work normally due to the current limiting effect of the constant current circuit. When VA is changed from high to low, the process is reversely repeated. The voltage of the LED strings can always follow the change of the drive voltage, so that the LED works in the normal working range.

Figure 4:
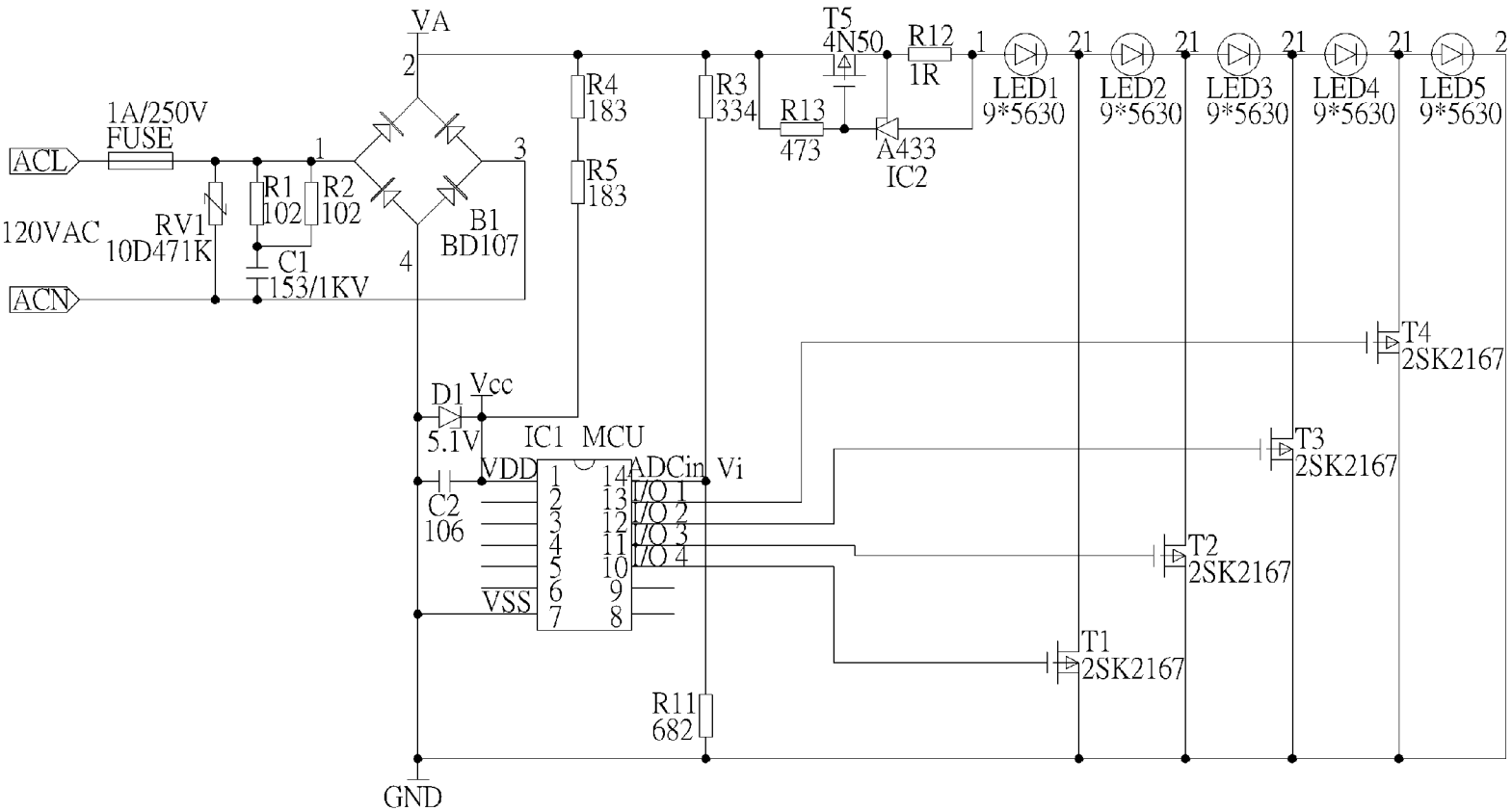
FIG. 4 is another circuit diagram of the LED lamp with the self-adaptive drive circuit of the invention.

FIG. 4 shows another example of the invention.

A 24 W LED dimmable ceiling lamp with 120 VAC input is designed in the example.

The mains supply is 120 V alternating current for example. After the mains supply passes through a FUSE, it is changed from an alternating current to a fluctuating direct current VA by a bridge rectifier B1 to serve as the drive voltage of the LED lamp. RV1 is a lightning protection piezo-resistor, and R1, R2 and C1 are used for supplying continuous current to a controllable silicon dimmer.

The LED lamp is formed by serially connecting five LED lamp strings: LED1, LED2, LED3, LED4 and LED5, wherein each lamp string is formed by serially connecting nine Samsung 5630 lamp beads, so an LED lamp string in the diagram represents nine series LED lamp beads. The voltage of a single 5630 is about 3.2V, and the voltage of the series nine lamp beads is:

$$9*3.2=28.8V$$

The total voltage of the five strings of LED lamp beads is:

$$5*28.8=144V$$

which is lower than the peak of the mains supply: 120*1.4=168V.

In the embodiment, the singlechip MCU is used for detecting the change of the LED drive voltage VA in real time. R4, R5, C2 and D1 supply 5.1 V power to the singlechip. The VA is divided by the R3 and the R11 and connected to the ADC input end of the MCU, and the ADC of the MCU is used for detecting the magnitude of the VA and controlling the connection and the disconnection of the MOS transistors T1-T4 through I/O 1-I/O 4. The quantity of the LEDs connected to the circuit is controlled according to the magnitude of VA. The LED voltage automatically adapts to the change of the drive voltage. The circuit parameters and the program are designed to satisfy the following relation:

$$Vadc=VA*R11/(R3+R11)$$

TABLE 2

| VA | Vi | I/O1 | I/O2 | I/O3 | I/O4 |
|---|---|---|---|---|---|
| <49.5 V | <1 V | high output | high output | high output | high output |
| >49.5 V | >1 V | high output | high output | high output | low output |
| >74.3 V | >1.5 V | high output | high output | low output | low output |
| >99 V | >2 V | high output | low output | low output | low output |
| >124 V | >2.5 V | low output | low output | low output | low output |

The current limiting circuit is consisted of an IC2 reference voltage source and a constant current circuit including an MOS transistor T5, an R12 and an R13. The controllable switch unit is realized by MOS transistors (T1, T2, T3 and T4 in FIG. 3). The output end (I/O) of the singlechip is connected with the grids of the MOS transistors, so the MOS transistors are turned on when the output of the singlechip is high; the MOS transistors are turned off when the output of the singlechip is low. The output state of the singlechip directly controls the connection/disconnection of the MOS transistors.

Figure 5:
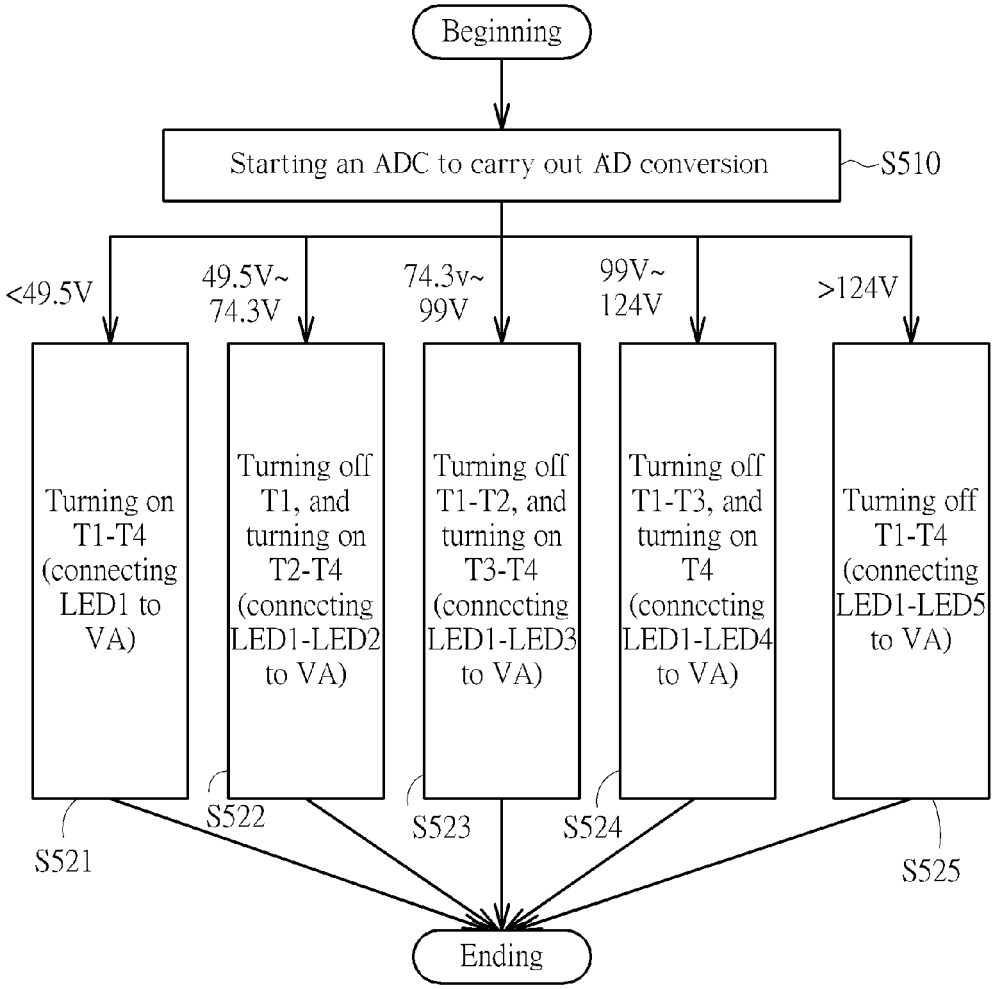
FIG. 5 is a program flow diagram of a singlechip in an example of the invention.

The program flow diagram is as shown in FIG. 5. The working principle is that the ADC of the singlechip detects the magnitude of the drive voltage VA in real time and controls the connection/disconnection of the MOS. The relation is designed as Table 2. The LEDs can adapt to the fluctuating change of the drive voltage and work normally. The flow specifically comprises:

S510, starting the ADC to carry out A/D conversion, performing analog-to-digital conversion on the drive voltage VA, and comparing; if the voltage is less than 49.5, executing S521; if the voltage is between 49.5V and 74.3V, executing S522; if the voltage is between 74.3V and 99V, executing S523; if the voltage is between 99V and 124V, executing S524; if the voltage is more than 124V, executing S525;

S521, turning on T1-T4 (connecting LED1 to VA), and ending;

S522, turning off T1, turning on T2-T4 (connecting LED1-LED2 to VA), and ending;

S523, turning off T1-T2, turning on T3-T4 (connecting LED1-LED3 to VA), and ending;

S524, turning off T1-T3, turning on T4 (connecting LED1-LED4 to VA), and ending; and S525, turning off T1-T4 (connecting LED1-LED5 to VA), and ending.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An LED lamp with a self-adaptive drive circuit, the LED lamp comprising:

a plurality of series-connected LED lamp strings, wherein each LED lamp string comprises a plurality of series LED lamp beads; and a self-adaptive drive circuit in communication with the plurality of LED lamp strings, the self-adaptive drive circuit comprising a rectifying unit configured to convert an AC voltage to a rectified drive voltage, a current limiting unit configured to perform current limitation or constant current on the drive voltage and to input the drive voltage to a first of the LED lamp strings, a voltage detection and connectivity control (VDCC) unit, and a plurality of controllable switch units controlled by the VDCC unit;

wherein each controllable switch unit selectively connects a different one of the series-connected LED lamp strings to ground, a distal one of the LED lamp strings being connected directly to ground;

wherein the VDCC unit includes a plurality of comparators configured to compare the drive voltage to a plurality of reference voltages defining a plurality of voltage ranges, thereby determining the voltage range of the drive voltage, a first one of the plurality of comparators being in communication with a first voltage, a second voltage, and the drive voltage; and wherein each of the controllable switch units is associated with one of the voltage ranges, the VDCC unit further configured to disconnect any controllable switch unit not associated with the determined voltage range, and to connect any controllable switch unit associated with the determined voltage range, such that no more than one controllable switch unit is connected in series with the LED lamp strings at any time.

2. The LED lamp of claim 1, wherein the voltage detection and connectivity control unit comprises a plurality of comparators connected with the controllable switch units, and the comparators are used for controlling the controllable switch units according to the comparison results of the drive voltage and the reference voltages.

3. The LED lamp of claim 1, wherein the voltage detection and connectivity control unit comprises a singlechip having an analog-digital converter connected with an output end of the rectifying unit and at least one output port connected with the controllable switch units, the singlechip configured to compare the drive voltage and the reference voltages in real time and to control connection/disconnection of the controllable switch units via the at least one output port.

4. The LED lamp of claim 1, wherein the VDCC unit comprises a stable voltage source having a voltage output, and a plurality of reference voltage divider resistors configured to divide the voltage output of the stable voltage source into the reference voltages.

5. The LED lamp of claim 1, wherein the AC voltage is set as U, a total quantity of the LED lamp strings is set as n, a voltage drop of each LED lamp string is set as U1, and the relation ($n*U1<1.4*U$) is satisfied by the self-adaptive drive circuit.

6. The LED lamp of claim 1, wherein an input end of the rectifying unit is connected to the AC voltage, an output end of the rectifying unit is connected with an input end of the VDCC unit, a connecting point of each LED lamp string is grounded through a respective controllable switch unit, an output end of the rectifying unit is connected with a first of the LED lamp strings through the current limiting unit, and an output end of the VDCC unit is connected with a respective control end of each controllable switch unit.

7. A self-adaptive drive circuit for an LED lamp, the self-adaptive drive circuit comprising:

a first LED lamp string connected in series with a second LED lamp string;

a third LED lamp string connected in series with the second LED lamp string, the third LED lamp string being connected directly to ground;

a voltage rectifier providing a rectified drive voltage to the first LED lamp string;

a first controllable switch unit connected between the first LED lamp string and ground;

a second controllable switch unit connected between the second LED lamp string and ground; and a voltage detection and connectivity control (VDCC) unit connected between the voltage rectifier and respective control ends of the first and second controllable switch units, the VDCC unit configured to compare the drive voltage to a reference voltage, to open the first controllable switch unit and close the second controllable switch unit when the drive voltage is higher than the reference voltage, and to open the second controllable switch unit and close the first controllable switch unit when the drive voltage is lower than the reference voltage;

wherein the VDCC includes a comparator in communication with a first voltage, a second voltage, and the drive voltage.

8. The self-adaptive drive circuit of claim 7, further including a current limiting unit connected between the rectifier unit and the first LED lamp string.

9. The self-adaptive drive circuit of claim 8, wherein the current limiting unit is configured to limit current or to provide constant current with respect to the drive voltage and to input the drive voltage to the first LED lamp string.

10. The self-adaptive drive circuit of claim 7, wherein the VDCC unit comprises a comparator in communication with the first controllable switch unit, and the comparator is configured to selectively open and close the first controllable switch unit based on the comparison of the drive voltage to the reference voltage.

11. A self-adaptive drive circuit for an LED lamp, the self-adaptive drive circuit comprising:

a plurality of series-connected LED lamp strings, each having a first end and a second end, a distal one of the LED lamp strings being connected directly to ground;

a plurality of controllable switch units, each of the controllable switch units selectively and independently connecting the second end of a respective LED lamp string to ground;

a voltage rectifying unit in communication with the first end of a first one of the series-connected LED lamp strings; and a voltage detection and connectivity control (VDCC) unit in communication with the voltage rectifying unit and with each of the controllable switch units;

wherein the VDCC unit is configured to compare a drive voltage produced by the voltage rectifying unit to one or more reference voltages using a plurality of comparators, and to light a selected portion of the LED lamp strings based on the comparison result;

wherein the VDCC unit is configured to light the selected portion of the LED lamp strings by closing a selected one of the controllable switch units and opening a remainder of the controllable switch units; and wherein a first one of the plurality of comparators is in communication with a first voltage, a second voltage, and the drive voltage.

12. The self-adaptive drive circuit of claim 11, further including a current limiting unit connected between the voltage rectifying unit and the first one of the series-connected LED lamp strings, the current limiting unit having a plurality of resistors connected in series to limit current in the self-adaptive drive circuit.

13. The self-adaptive drive circuit of claim 11, wherein the plurality of series-connected LED lamp strings numbers from four to ten LED lamp strings.

14. The self-adaptive drive circuit of claim 11, wherein each of the controllable switch units selectively connects the second end of the respective LED lamp string to a negative end of the voltage rectifying unit.

15. The self-adaptive drive circuit of claim 11, wherein the VDCC unit comprises a plurality of comparators connected with the controllable switch units, and the comparators are configured to selectively open and close the controllable switch units based on the comparison of the drive voltage and the one or more reference voltages.

* * * * *